United States Patent [19]

Vossler

[11] Patent Number: 4,836,517

[45] Date of Patent: Jun. 6, 1989

[54] FASCIA BOARD INSTALLING APPARATUS

[76] Inventor: Carl M. Vossler, 3895 Pershing La., Carson City, Nev. 89701

[21] Appl. No.: 141,917

[22] Filed: Jan. 11, 1988

[51] Int. Cl.[4] ..... B25B 1/20; B27M 3/02

[52] U.S. Cl. ..... 269/41; 269/904

[58] Field of Search ..... 269/41, 74, 152, 154, 269/156, 904

[56] References Cited

U.S. PATENT DOCUMENTS

| | | | |
|---|---|---|---|
| 4,340,100 | 7/1982 | Anderson, II | 269/41 X |
| 4,564,182 | 1/1986 | Svajgl | 269/904 X |
| 4,685,369 | 8/1987 | Beaner | 269/41 X |

*Primary Examiner*—Steven Mottola

*Attorney, Agent, or Firm*—Richard C. Litman

[57] ABSTRACT

An apparatus for temporarily suspending or supporting a fasica board during the installation thereof, along the eaves or the gable end of a frame of a roof is described, wherein the device includes a U-shaped frame for supporting or suspending the fascia board. The U-shaped frame is engagedly cooperating with a rectangular shaped frame for attachment to either a rafter or an outrigger, respectively, of the frame of the roof. The apparatus provides an improved method of installing a fascia board, wherein one person, can install the fascia board and upon completion installation thereof, the apparatus may be easily removed and applied to another section of the roof.

4 Claims, 2 Drawing Sheets

FIG. 3
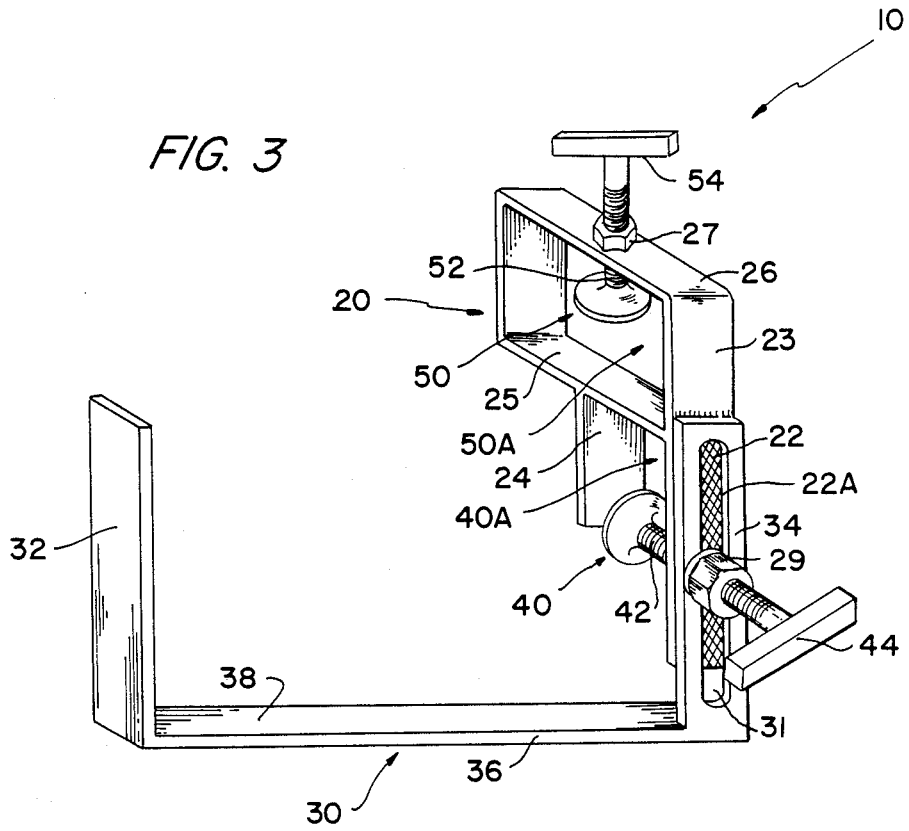
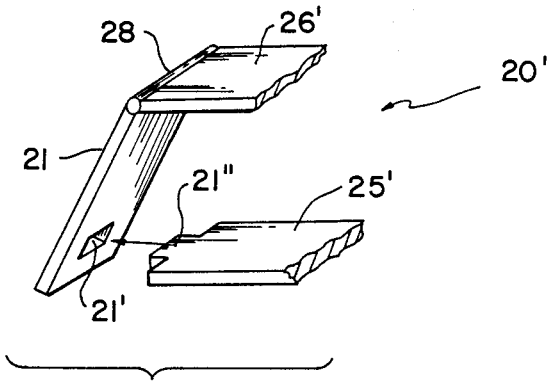
FIG. 3A

FASCIA BOARD INSTALLING APPARATUS

BACKGROUND OF THE INVENTION

The invention relates to devices used in the field of carpentry and more particularly, to a device for suspending one end of a fascia board from the eaves or gable end of the framework of a roof, while the fascia board is attached to the rafters or outriggers, respectively, of the roof. The invention provides support for an end or an intermediate segment of an elongated fascia board.

During construction of a roof a fascia board may be installed to provide cosmetic qualities to the house. This fascia board may be installed along the the eaves or gable end of the roof for cosmetic purposes. This task usually requires two or more people to perform the duty at hand; one or more persons to hold or suspend the fascia board at one end and another person to align and nail the fascia board into the rafters or outriggers of the roof.

Therefore, the present invention, a fascia board installing apparatus, which is light weight yet constructed of resilient material, such that it may be temporarily secured to the rafter or outrigger of the framework of a roof allowing the task of attaching an elongated fascia board to the eaves or gable end of the roof to be accomplished safely and efficiently by one person.

The method of construction of the invention is more fully described herein.

DESCRIPTION OF THE PRIOR ART

Various prior art fascia board suspenders and the like, as well as the method of their construction in general, are known and are found to be exemplary of the U.S. prior art. They are:

| U.S. Pat. No. | Inventor |
|---|---|
| 2,686,960 | N. L. Leroy |
| 2,889,145 | C. G. Hoffman |
| 3,092,900 | J. E. Smith et al |
| 3,373,988 | M. J. McKelvey |
| 4,564,182 | D. E. Svajgl |

U.S. Pat. No. 2,686,960 to LeRoy discloses a U-shaped holding tool for installing building cave gutters.

U.S. Pat. No. 3,092,900 to Smith discloses a work supporting and guiding device. It consists of an L-shaped member and an attached nail. When nailed into a joist, it forms a slot capable of holding a large, sheet-like structure.

U.S. Pat. No. 4,564,182 to Svajgl discloses a U-shaped temporary support for gutters.

The remaining patents disclose devices for holding parts of buildings in place during construction.

These patents, or known prior uses, teach and disclose various types of support devices, as well as methods of their construction; but none of them, whether taken singly or in combination disclose the specific details of the combination of the invention as to bear upon the claims of the present invention.

SUMMARY OF THE INVENTION

An object of the invention is to provide a fascia board installing apparatus that is safe in use and provides a means for supporting or suspending one portion of a fascia board, while the fascia board is being installed along the eaves portion of a frame structure of a roof.

Another object of the invention is to provide an apparatus that is safe in use and provides a means for supporting one end of a fascia board during the installation thereof while it is being installed along the gable end of a roof structure.

A further object of the invention is to provide an apparatus which allows one person to install an elongated fascia board to a roof structure as opposed to two or more people installing the same.

A still further object of the invention is to provide a device which is easy to install upon a roof support or a structure attached thereto, and may be readily removed therefrom after the fascia board has been installed.

With these and other objects in view which will more readily appear as the nature of the invention is better understood, the invention consists in the novel construction, combination and arrangements of parts hereinafter more fully described, illustrated and claimed, with reference being made to the appended drawing.

BRIEF DESCRIPTION OF THE DRAWINGS

FIG. 3 is a perspective view of the apparatus.

FIG. 3A is an alternative view of the rectangular frame portion of the apparatus, wherein a hinged member or wall is provided, thereby facilitating the removal of the device from the gable portion of the roof after the fascia board has been installed.

DESCRIPTION OF THE PREFERRED EMBODIMENT

Figure 1:
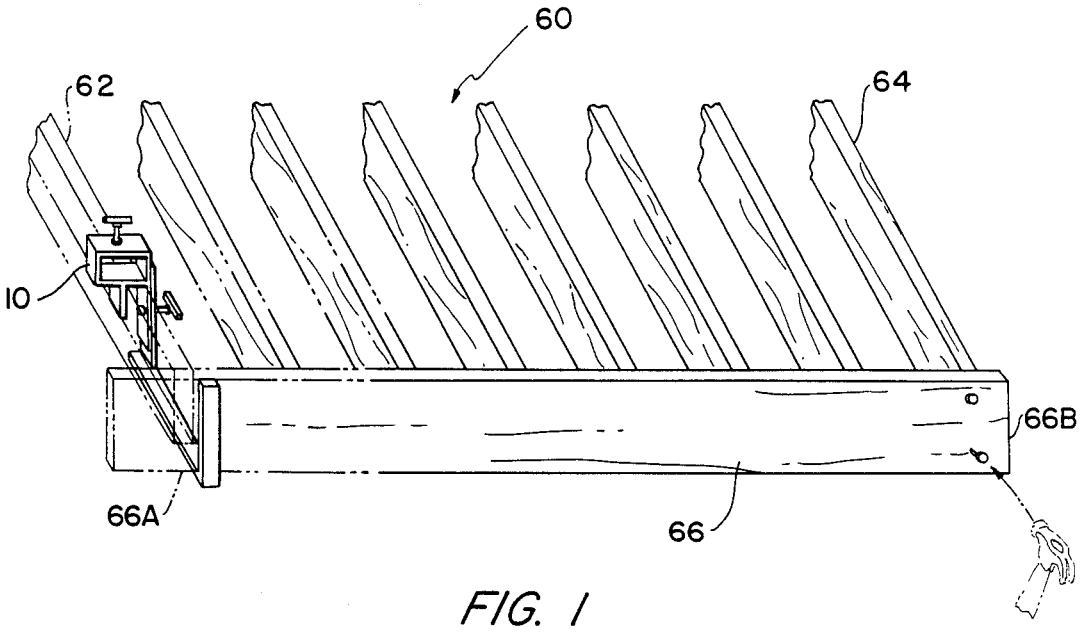
FIG. 1 is a perspective view of the eaves portion of a roof having the apparatus attached thereto, and illustrating the apparatus supporting the fascia board while it is being installed.

Referring now to the drawings, there is shown in FIG. 1 the device 10 which is generally attached to a rafter 62 of the eaves portion of the roof structure 60. The device 10 is adapted to receive the end or an intermediate portion of an elongated fascia board 66A of FIG. 1, while the opposing end of the fascia board 66B is being attached to a laterally positioned rafter 64. The apparatus 10 will be described in more detail hereinafter. As seen in FIG. 3, the device 10 comprises a U-shaped frame 30 having a base 38 between a first substantially perpendicularly disposed arm 32 and a second substantially perpendicularly disposed arm 34 as seen in the drawings.

The device 10 further comprises a rectangular shaped frame 20 having a substantially vertically disposed member 22 extending downwardly from an inner wall 23 of the rectangular shaped frame 20. This substantially vertically disposed member or arm 22 engagedly juxtaposed along the second substantially perpendicularly disposed arm 34 of the U-shaped frame (30). The second substantially disposed arm 34 also including an elongated slot 31 or opening therein; and the substantially vertically disposed arm 22 including an aperture 29 therethrough, such that a first clamping device 40 may be horizontally disposed through the elongated slot 31 and the aperture 29. This arrangement serves the dual purpose of maintaining the vertical alignment between the U-shaped frame 30 and rectangular shaped frame 20 and also provides a vice or clamping means 40 for the rafter receiving channel 40A formed by the downwardly extending first and second substantially vertically disposed arms 22 and 23 of the lower wall 25 of the rectangular shaped frame 20. A second aperture or opening 27 is disposed through the upper wall 26 of the rectangular frame 20, and includes a second vice or clamping means 50 therethrough for the structure or outrigger 76 receiving channel 50A of the rectangular shaped frame 20. The clamping devices 40 and 50 provide adjustable vice grip means for either a rafter 62 or an outrigger 76, respectively during the installation of a fascia board along the eaves segment 60 or the gable end 70 of a roof framework. The aforementioned rafter clamping channel and outrigger clamping channel constructed somewhat larger than the standard 2"×4" beams, such that a plurality of beams may be employed when using the apparatus.

Figure 2:
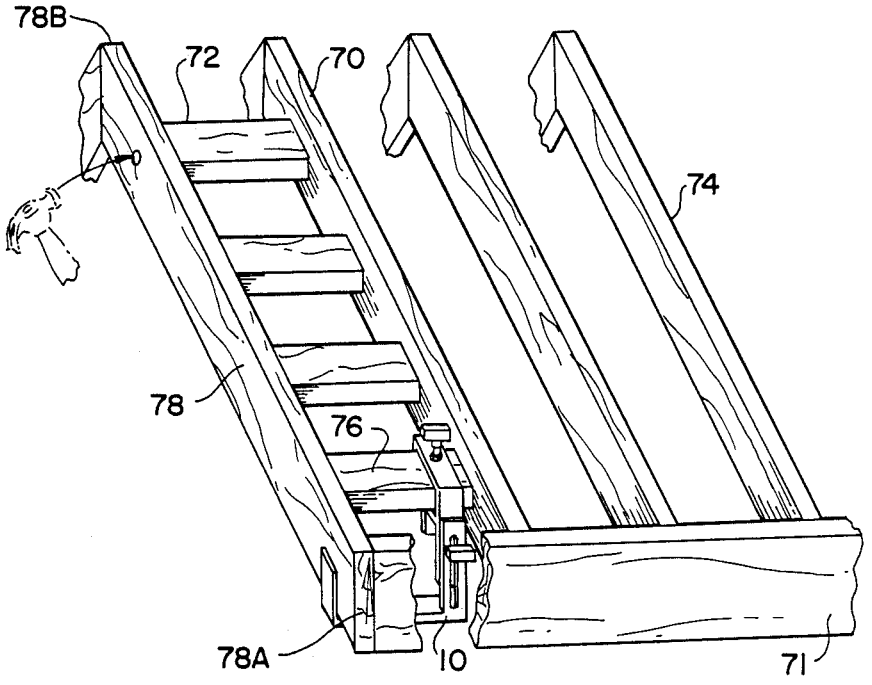
FIG. 2 is a view similar to FIG. 1 except the apparatus is attached to the gable portion of the roof while the fascia board is being installed.

As seen in FIGS. 1–3 the apparatus 10 includes a fascia board receiving element, wherein the base 38 and the first substantially perpendicularly disposed arm 32 of the U-shaped frame support an elongated fascia board 66 as seen in FIG. 1. In this embodiment the apparatus 10 is attached to the rafter 62 of the eaves portion 60 of the framework of the roof, allowing an end or intermediate part of an elongated fascia board 66A to be supported while an opposing end of the fascia board 66B may be nailed into place at is outermost section with nails 69. Once the nailed portion of the fascia board 66B is in place, the person may align the supported portion of the fascia board 66A in place and then secure this end 66A with nails, completing the fascia board 66 installation process. Once the process has been completed, the apparatus 10 may be easily removed by loosening the adjustable vice or clamping means 40 of the device 10, and removing the apparatus 10 from the rafter 62 of the eaves portion framework 60.

Similarly, as seen in FIGS. 2 and 3, the device 10 comprising a second channel 50 for receiving and securing to the outrigger 76 of a gable end 70 of a roof structure or framework. IN this embodiment an elongated fascia board 78 is supported or suspended at one end 78A by the apparatus 10, such that the person may nail the opposing end 78B to the outrigger 72 of the gable end 70 of the house, thereafter the person removes the apparatus 10 from the outrigger 76, and proceeds in the installation process by nailing the fascia board 78 at the prior supported end 78A, thereby completing the fascia board installing process or procedure.

Alternately, as seen in FIG. 3A an alternative rectangular shaped frame 20' of the apparatus 10 may include an alternate second side wall 21 which extends slightly beyond the lower wall 25' of the rectangular shaped frame 20'. The second wall 21 includes a hinged member 28 attached to the upper wall 26', and a notch or aperture 21' which engages with a flange 21" extending from the lower wall 25' of the rectangular shaped frame 20. When employed along the outrigger 76 of FIG. 2, the alternate embodiment will allow the user to install the fascia board 76 without removing the apparatus prior to completing the installation of the fascia board 76, wherein upon nailing in the supported end 78A of the elongated fascia board 78 and securing same in place, the user may disengage the hinged second wall 21' from the lower wall 25' by displacing the flanged segment element 21" from the notch 21' and swinging the hinged second wall 21' outwardly, thus facilitating the removal of the apparatus 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, will be understood to fall within the scope of the invention.

What is claimed is:

1. A fascia board installing apparatus adapted to be temporarily attached to a support of a roof, or a structure attached thereto, comprising:

a U-shaped frame;

a rectangular shaped frame, means for cooperatively engaging said U-shaped frame to said rectangular shaped frame, said U-shaped frame including a base between a first substantially perpendicularly disposed arm and a second substantially perpendicularly disposed arm, said first substantially perpendicularly disposed arm adapted to receive an end or intermediate part of the fascia board, said rectangular shaped frame including an upper wall, a lower wall, a first side wall and a second side wall; said walls thereby forming a first channel providing means for temporarily attaching said apparatus to said structure attached to said support of said roof, said first channel of said rectangular shaped frame also having adjustable clamping means thereon, said rectangular shaped frame further including a first substantially vertically disposed member and a second substantially vertically disposed member extending downwardly from said lower wall of said rectangular shaped frame; said first substantially vertically disposed member extending linearly from said first side wall, said second substantially vertically disposed member extending symmetrically from said lower wall, said members thereby providing a second channel, said second channel providing means for temporarily attaching said apparatus to said support of said roof, said means for cooperatively engaging said U-shaped frame to said rectangular shaped frame including said first substantially vertically extending arm of said rectangular shaped frame engagedly juxtaposed along said first substantially perpendicularly disposed arm of said U-shaped frame, thereby clasping said U-shaped and said rectangular shaped frame cooperatively.

whereby upon attaching said apparatus to said support of said roof, or said structure attached thereto, said fascia board is supported while said fascia board is being installed; and after said fascia board is installed said apparatus providing yieldable means for removing said apparatus.

2. A fascia board installing apparatus of claim 1 wherein, said means for temporarily attaching said apparatus to said structure includes said apparatus temporarily attached to an outrigger of a gable end of said roof, and upon receiving said end or said intermediate part of said fascia board; said first substantially perpendicularly disposed arm thereby provides support for said fascia board during said installation thereof upon said gable end of said roof.

3. A fascia board installing apparatus as described in claim 1 wherein, said means for temporarily attaching said apparatus to said structure includes said apparatus temporarily attached to a rafter of an eaves segment of said roof, and upon receiving said end or intermediate part of said fascia board; said first substantially perpendicularly disposed arm, thereby provides support for said fascia board during said installation thereof upon said eaves segment of said roof.

4. An apparatus as set forth in claim 2, wherein said yieldable support means includes a hinged member attached to said first side wall of said rectangular shaped frame.

* * * * *